US005398526A

United States Patent [19]

Liu

[11] Patent Number: 5,398,526

[45] Date of Patent: Mar. 21, 1995

[54] ASSEMBLED INTERLOCK NEEDLE CYLINDER STRUCTURE OF A CIRCULAR KNITTING MACHINE

[76] Inventor: Chin M. Liu, No. 4, Lane 84, Jiun Ing Street, Shuh Lin Town, Taipei County, Taiwan, Prov. of China

[21] Appl. No.: 277,104

[22] Filed: Jul. 20, 1994

[51] Int. Cl.[6] ..... D04B 9/08

[52] U.S. Cl. ..... 66/8; 66/19

[58] Field of Search ..... 66/7, 8, 17, 19, 57

[56] References Cited

U.S. PATENT DOCUMENTS

| | | | |
|---|---|---|---|
| 504,417 | 9/1893 | Franck | 66/8 X |
| 3,817,058 | 6/1974 | Lombardi | 66/19 X |
| 5,285,662 | 2/1994 | Lonati et al. | 66/8 X |

FOREIGN PATENT DOCUMENTS

| | | | |
|---|---|---|---|
| 1173435 | 2/1959 | France | 66/8 |
| 3428885 | 5/1985 | Germany | 66/8 |
| 1079169 | 8/1967 | United Kingdom | 66/19 |
| 199316 | 8/1967 | U.S.S.R. | 66/19 |

OTHER PUBLICATIONS

Singer Knitting Machinery, SUPREME circular knitting machine Parts Manual, received in Patent Office Jun. 1969, p. 10.

*Primary Examiner*—John J. Calvert

*Attorney, Agent, or Firm*—Morton J. Rosenberg; David I. Klein

[57] ABSTRACT

An assembled interlock needle cylinder structure of a circular knitting machine, comprising an annular upper body and an annular main body. The main body includes an annular base seat and an annular upper seat detachably associated with the base seat. Multiple slender needle channels are disposed on outer surface of the base seat. A top end of the base seat has an inward inclined surface on which several upright bosses are disposed. Each of the bosses is formed with a thread hole. An outer right portion of the upper seat has an inclined surface parallel to the inclined surface of the base seat. A plane portion of the upper seat is formed with several through holes aligned with the thread holes of the bosses. An L-shaped engaging surface is formed on a bottom end of the upper seat for engaging with the bosses of the base seat. The upper body has a slant bottom surface and a plane top surface formed with multiple needle channels. Between the needle channels are slantly disposed wind holes.

5 Claims, 7 Drawing Sheets

ASSEMBLED INTERLOCK NEEDLE CYLINDER STRUCTURE OF A CIRCULAR KNITTING MACHINE

BACKGROUND OF THE INVENTION

The present invention relates to an assembled interlock needle cylinder structure of a circular knitting machine, and more particularly to an interlock needle cylinder which can be disassembled so that the cotton chips generated from cotton yarns and accumulated in a corner during the knitting operation of the knitting needles can be easily cleaned up. Moreover, in case a part of the needle cylinder is damaged, this part can be solely replaced without replacing the whole needle cylinder.

It is known that in a conventional circular knitting machine, the knitting needles have been greatly improved in order to create different figures and stripes. However, the knitting needles are designed with different shapes for knitting different stripes. Once the shape of the knitting needle is modified or changed, the relevant operating structures such as the sinker, front needle seat and rear needle seat, etc. must be correspondingly changed. Especially during the knitting operation of a circular knitting machine, when the knitting needles continuously knit the cotton yarns, cotton chips will be produced from the cotton yarns. When suffering the shocking force during the knitting operation, such cotton chips are likely to drop down onto the needle channels and block the same. This will affect the production amount of the knit cloth. In addition, in case the cotton chips are knit into the cloth, the cloth will be mingled with the cotton chips and have a poor quality.

Furthermore, in a conventional circular knitting machine, multiple needle channels are formed on an outer surface of the needle cylinder and a relatively deep annular groove is formed at upper ends of the needle channels around the needle cylinder, whereby when the needles operate up and down in the needle channels, the produced cotton chips will not only drop out of the needle cylinder but also drop into the annular groove. However, the annular groove has corners and the cotton chips are likely to drop into these corners. Although a blowing pipe is provided on an outer side of the needle cylinder to blow away the cotton chips, it is still difficult to effectively clean up the cotton chips from the corners. The cotton chips will accumulate more and more after a long period of use. This will lead to malfunction of the knitting needles. Although the cotton chips can be cleaned up manually, it is time-costing and labor-wasting to totally clean up the cotton chips. In addition, the conventional needle cylinder is integrally molded, so that in case a part of the needle cylinder is worn out or damaged, the whole needle cylinder must be replaced.

Therefore, it is necessary to provide an improved interlock needle cylinder of a circular knitting machine to solve the above problems.

SUMMARY OF THE INVENTION

It is therefore a primary object of the present invention to provide an assembled interlock needle cylinder structure of a circular knitting machine. The present needle cylinder is composed of a main body and an upper body. The main body is composed of a base seat and an upper seat which is detachably associated with the base seat to define an inclined channel, whereby the cotton chips accumulating thereon will freely drop down out of the main body. Therefore, the knitting operation of the needles can be performed without obstruction of the cotton chips. Furthermore, in case of abrasion or damage of the needle cylinder, the same can be partially replaced to meet the economic requirement.

The present invention can be best understood through the following description and accompanying drawing, wherein:

DETAILED DESCRIPTION OF THE PREFERRED EMBODIMENT

Figure 1:
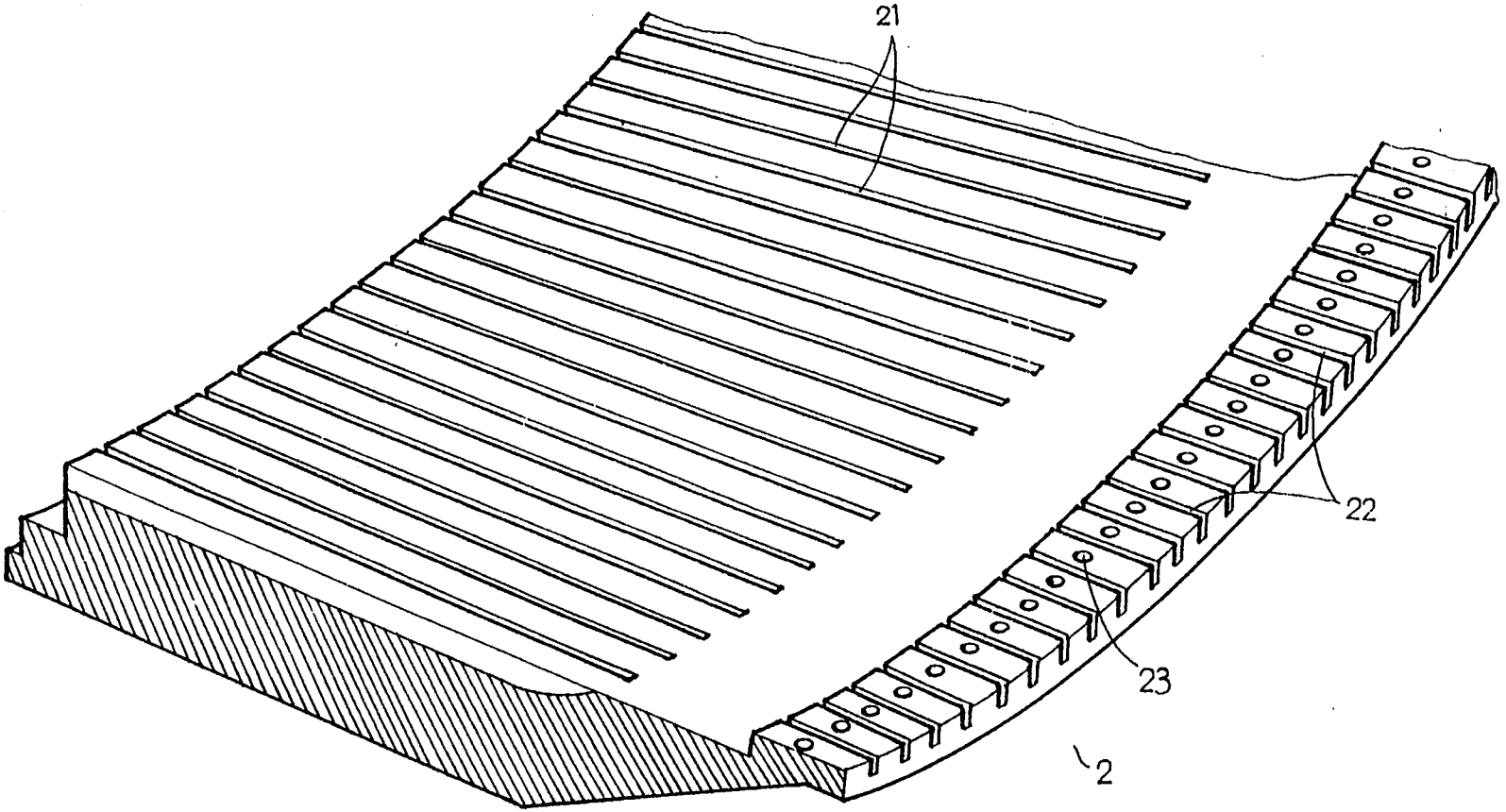
FIG. 1 is a perspective view of the upper body of the present invention.
Figure 2:
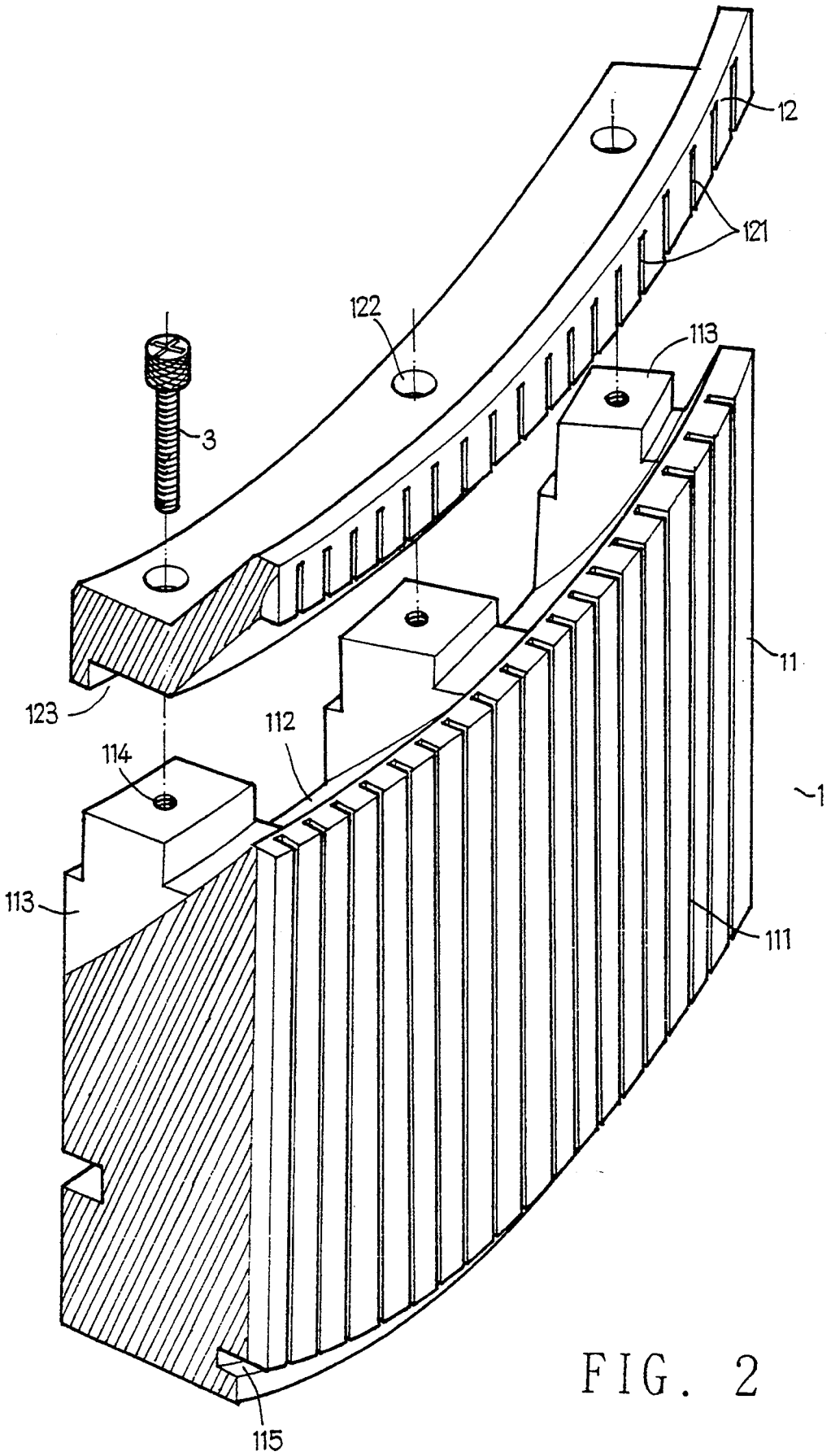
FIG. 2 is a perspective exploded view of the main body of the present invention.

Please refer to FIGS. 1 to 5. The needle cylinder of the present invention includes a main body 1 and an upper body 2. The main body 1 includes an annular base seat 11 and an annular upper seat 12 detachably associated with the base seat 11. Multiple needle channels 111 are disposed on outer surface of the base seat 11 at equal intervals for knitting needles 4 to move therein. Each needle channel is slender, having such a width that one knitting needle 4 can be snugly received therein. A top end of the base seat 11 has an inward inclined surface 112 on which several upright bosses 113 are formed. Preferably, there are 36 bosses 113 formed on the inclined surface 112 of the base seat 11. A front and a back shoulder portions are formed on a front and a back sides of each boss 113. A needle-fixing groove 115 is formed at bottom ends of the needle channels 111 around the base seat 11. The upper seat 12 is fixedly mounted on the base seat 11. An outer right portion of the upper seat 12 has an inclined surface parallel to the inclined surface 112 of the base seat 11. A front end of the upper seat 12 is disposed with needle channels 121 corresponding to the needle channels 111. A plane portion of the upper seat 12 is formed with several stepped through holes 122 aligned with thread holes 114 of the bosses 113. An L-shaped engaging surface 123 is formed on a bottom end of the upper seat 12 for snugly engaging with the bosses 113.

The upper body 2 is transversely disposed, having a plane portion formed with multiple needle channels 21. A front end of the upper body 2 is formed with an annular ring on which multiple needle channels 21 are formed. Between the needle channels 21 are disposed slant through wind holes 23. The upper seat 2 has a slant bottom surface which together with the main body 1 defines a fissure.

Figure 3:
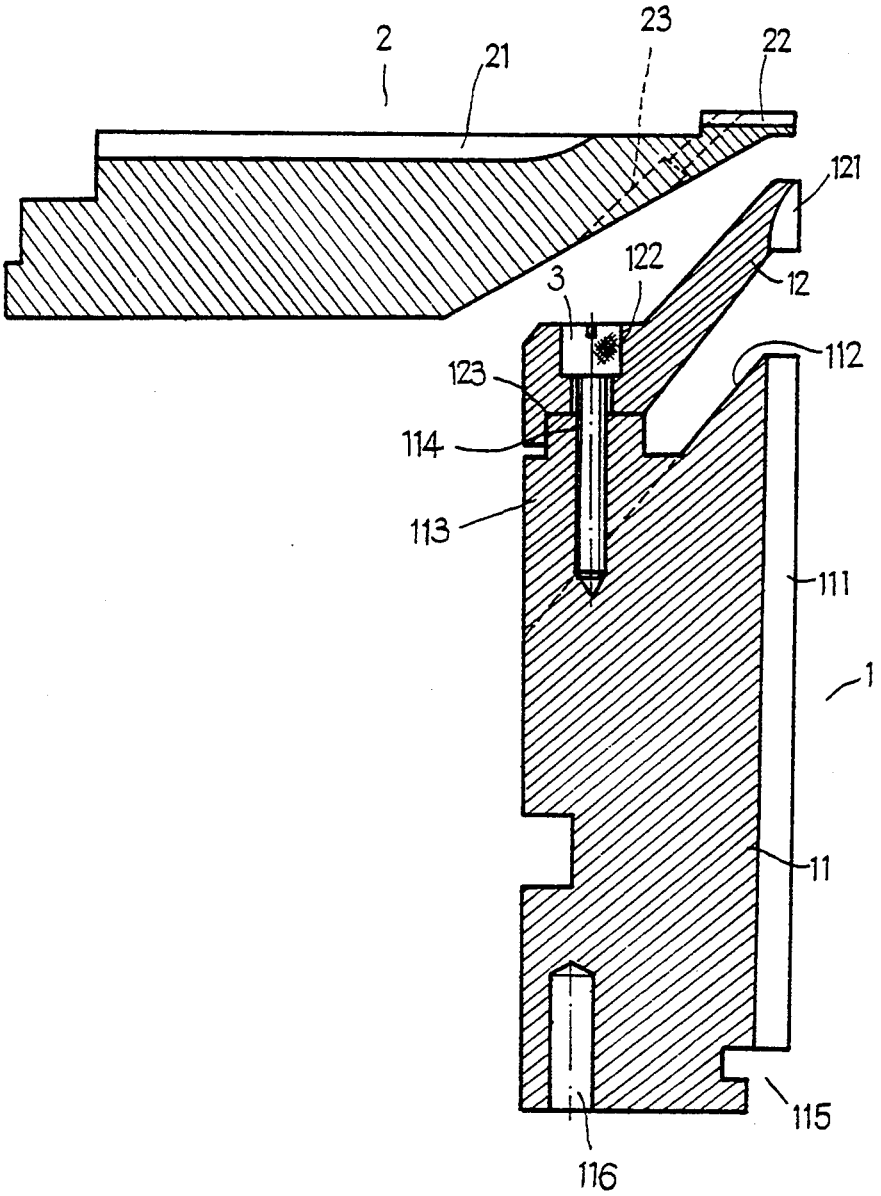
FIG. 3 is a longitudinal sectional assembled view of the present invention.
Figure 4:
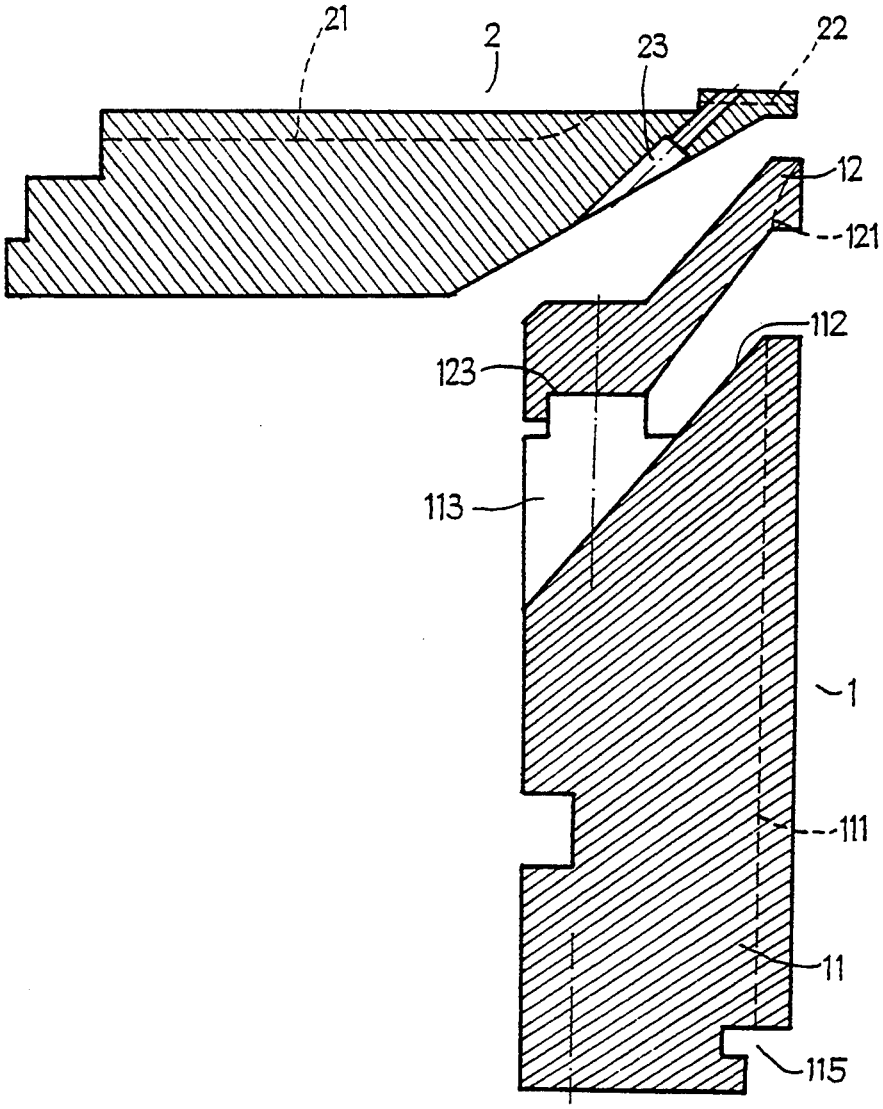
FIG. 4 is a view according to FIG. 3.

Please refer to FIGS. 3 and 4. After assembled, the upper body 2 is transversely disposed and the main body 1 is longitudinally disposed to define a fissure therebetween. By means of passing screws 3 through the through holes 122 of the upper seat 12 and screwing the screws 3 into the bosses 113 of the base seat 11, the base seat 11 and the upper seat 12 are detachably associated with the L-shaped connecting surface 123 engaging with the bosses 113 and shoulders thereof. Therefore, the base seat 11 is firmly assembled and locked with the upper seat 12. Referring to FIG. 4, after assembled, the inclined surface 112 between the 36 bosses 113 serve as slide down channels.

Figure 5:
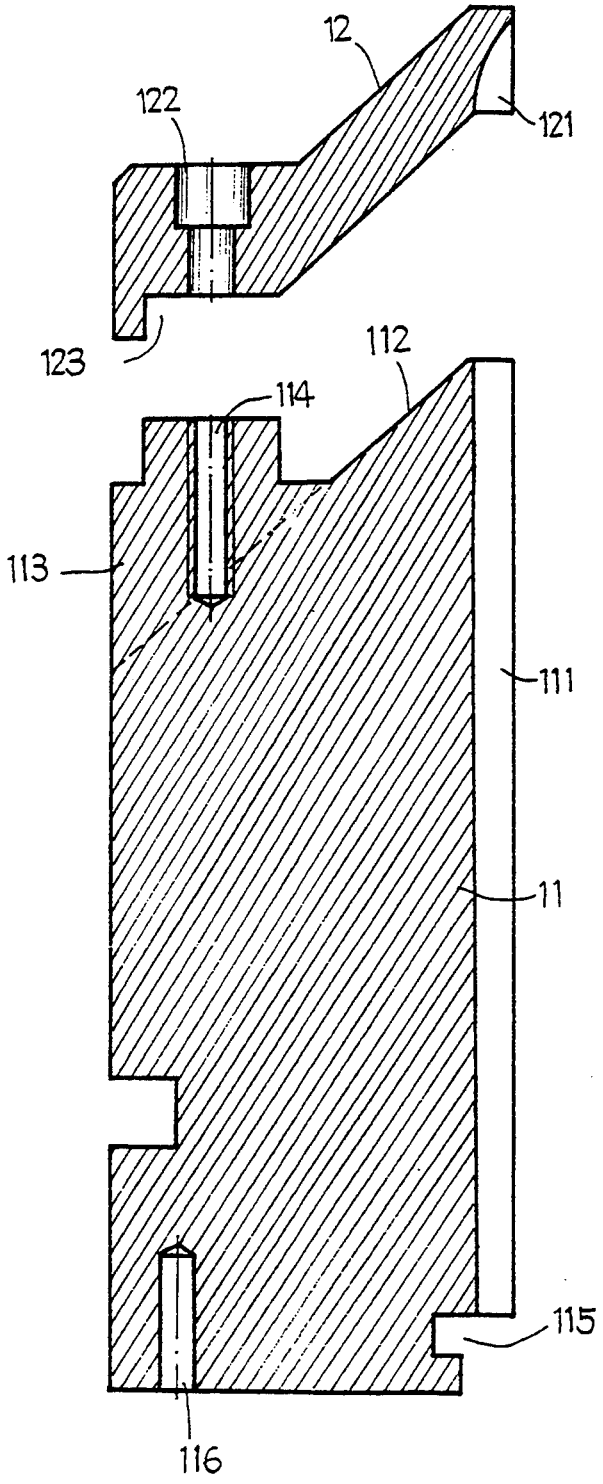
FIG. 5 is a longitudinal sectional view of the main body of the present invention.
Figure 6:
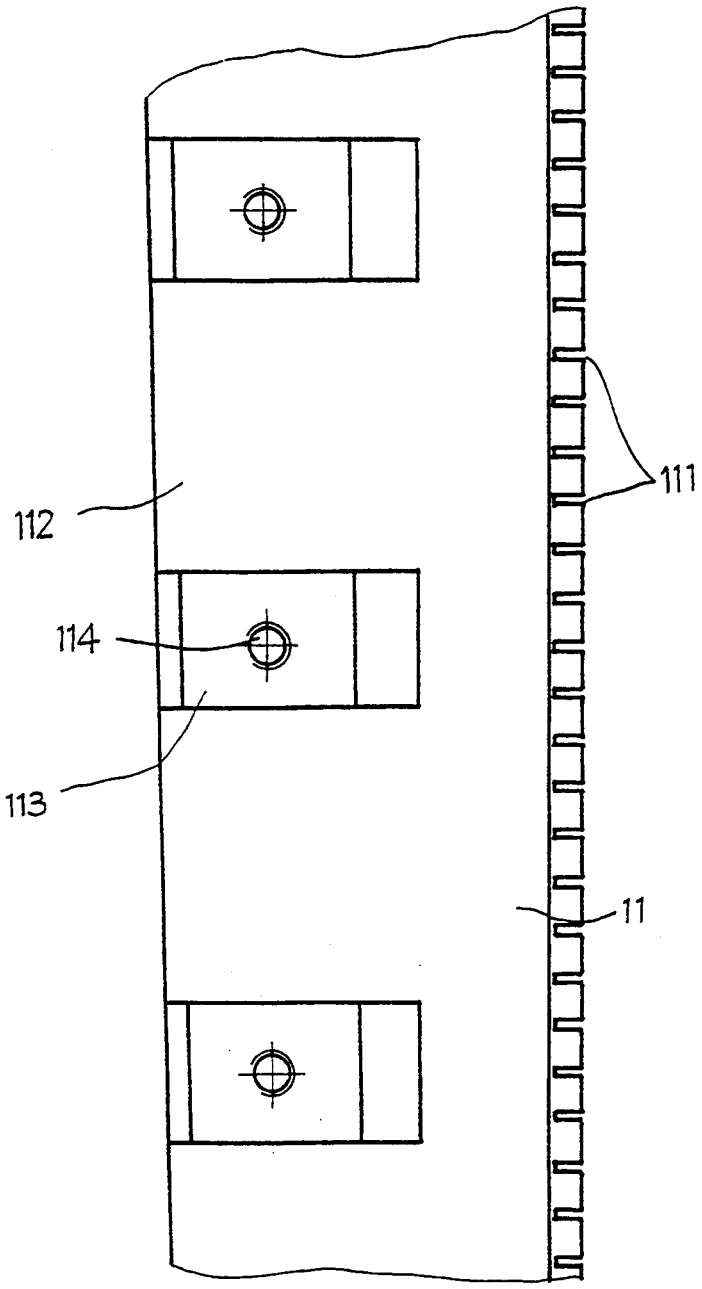
FIG. 6 is a top view of the base seat of the main body of the present invention.
Figure 7:
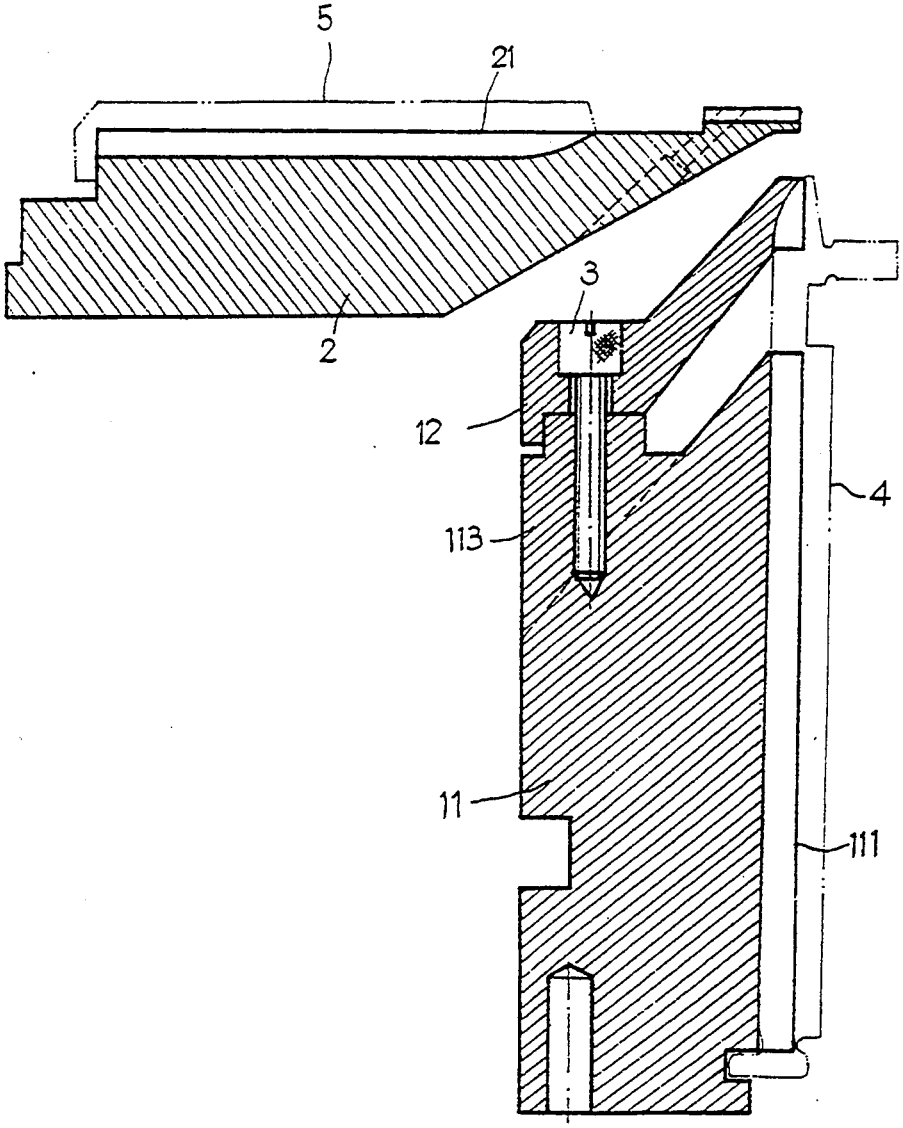
FIG. 7 is a sectional view showing the operation of the needles of the present invention.

Please refer to FIGS. 5 and 6. Multiple needle channels 111 are disposed on outer surface of the base seat 11 at equal intervals for knitting needles 4 to move therein. Each needle channel is slender, having such a width that one knitting needle 4 can be snugly received therein. A top end of the base seat 11 has an inward inclined surface 112 on which several upright bosses 113 are formed. A needle-fixing groove 115 is formed at bottom ends of the needle channels 111 around the base seat 11 to receive bottom ends of the needles FIG. 7 shows the operation of the assembly of the needle cylinder. The needles 4, 5 are respectively placed in the needle channels 111, 21 of the main body 1 and the upper body 2 to move back and forth therein. The cotton chips produced during the knitting operation of the needles 4, 5 will accumulate on the surfaces of the main body 1 and upper body 2. Blowing pipes are disposed on outer sides of the main body 1 and the upper body 2 for minimizing the amount of cotton chips accumulating on the surfaces thereof. The cotton chips accumulating outside the inclined surface 112 are blown by the blowing pipes to drop out of the inclined surface 112. The cotton chips accumulating in the front corners of the bosses 113 are easily cleaned up by means of disassembling the main body 1 after the knitting operation. Therefore, the problem of cleaning up the cotton chips is solved and in case a part of the interlock needle cylinder is worn out or damaged, the part can be solely replaced.

It is to be understood that the above description and drawings are only used for illustrating one embodiment of the present invention, not intended to limit the scope thereof. Any variation and derivation from the above description and drawings should be included in the scope of the present invention.

What is claimed is:

1. An assembled interlock needle cylinder structure of a circular knitting machine, comprising:

a main body having an annular base seat and an annular upper seat detachably associated with the base seat, multiple slender needle channels disposed on an outer surface of the base seat at equal intervals, each of the needle channels being a width for snugly receiving a knitting needle, a top end of the base seat having an inward inclined surface on which several upright bosses are disposed, each of the bosses formed with a thread hole, a front and a back shoulder formed on a front and a back side of each boss, a needle-fixing groove formed at bottom ends of the needle channels around the base seat, the upper seat being fixedly mounted on the base seat, the upper seat being formed with an upper planar portion, an outer front surface, and a lower inclined surface formed between the front surface and a lower L-shape engaging surface, the outer front surface having needle channels corresponding to the needle channels of the base seat, the planar portion formed with several through holes aligned with the thread holes of the bosses, whereby screws are passed through the through holes and screwed into the thread holes of the bosses to assemble the upper seat with the base seat; and an upper body transversely disposed above the main body, having a slant bottom surface and a plane top surface formed with multiple needle channels, a front end of the upper body being formed with an annular ring on which multiple needle channels are formed, and holes disposed between the needle channels.

2. An assembled interlock needle cylinder structure as claimed in claim 1, wherein the bosses of the base seat of the main body are rectangular and project upward from inner edge of the inclined surface of the base seat.

3. An assembled interlock needle cylinder structure as claimed in claim 1, wherein the inclined surface of the upper seat is parallel to the inclined surface of the base seat.

4. An assembled interlock needle cylinder structure as claimed in claim 1, wherein when the upper seat is assembled with the base seat, the L-shaped engaging surface of the upper seat engages with the bosses of the base seat.

5. An assembled interlock needle cylinder structure as claimed in claim 1, wherein the holes formed between the transverse needle channels of the upper body slantly pass through the upper body from upper side to lower side thereof.

* * * * *